US007029321B2

(12) United States Patent
Sato et al.

(10) Patent No.: US 7,029,321 B2
(45) Date of Patent: Apr. 18, 2006

(54) TERMINAL FOR COAXIAL CABLE, AND ATTACHMENT STRUCTURE AND ATTACHMENT METHOD FOR ATTACHING THE SAME TERMINAL FOR COAXIAL CABLE

(75) Inventors: Kensaku Sato, Tokyo (JP); Takuya Ikeda, Tokyo (JP); Hiroshi Iijima, Tokyo (JP); Hideaki Oshima, Tokyo (JP)

(73) Assignees: Hirose Electric Co., Ltd., Tokyo (JP); Nippon Sheet Glass Co., Ltd., Tokyo (JP)

( * ) Notice: Subject to any disclaimer, the term of this patent is extended or adjusted under 35 U.S.C. 154(b) by 0 days.

(21) Appl. No.: 11/116,423

(22) Filed: Apr. 28, 2005

(65) Prior Publication Data

US 2005/0245129 A1 Nov. 3, 2005

(30) Foreign Application Priority Data

Apr. 28, 2004 (JP) ..... 2004-132446

(51) Int. Cl.
*H01R 27/00* (2006.01)

(52) U.S. Cl. ..... 439/516; 439/581

(58) Field of Classification Search ..... 439/63, 439/581, 516, 916, 177
See application file for complete search history.

(56) References Cited

U.S. PATENT DOCUMENTS 3,743,748 A * 7/1973 Reeder ..... 174/75 C
5,603,636 A * 2/1997 Kanou et al. ..... 439/585
5,735,695 A * 4/1998 Heinrich ..... 439/63

FOREIGN PATENT DOCUMENTS

JP 2000-323213 A 11/2000
JP 2003-168499 A 6/2003

* cited by examiner

*Primary Examiner*—Ross Gushi
(74) *Attorney, Agent, or Firm*—Foley & Lardner LLP

(57) ABSTRACT

Since the invention makes a structure in which bent portions 18A, 18B of grounding pieces 16A, 16B of a center conductor side grounding portion 11 and bent portions 22A, 22B of grounding pieces 20A, 20B of an outer conductor side grounding portion 13 are connected to each other by joint portions 12A, 12B, solders contact portions 17A, 17B and 21A, 21B of the center conductor side grounding portion 11 and the outer conductor side grounding portion 13 respectively to a center conductor grounding side conductor portion F and an outer conductor grounding side conductor portion G of an antenna element of a glass board face 25*a*, and then breaks off the joint portions 12A, 12B and thereby separates the center conductor side grounding portion 11 and the outer conductor side grounding portion 13 from each other, the invention makes it possible to stably attach a center conductor and an outer conductor of the fore-end portion of a coaxial cable to the same positions as determined in a terminal for coaxial cable and to accurately and stably mount the center conductor and the outer conductor on the same positions as determined also with respect to the interval between them on a mounted object.

7 Claims, 7 Drawing Sheets

TERMINAL FOR COAXIAL CABLE, AND ATTACHMENT STRUCTURE AND ATTACHMENT METHOD FOR ATTACHING THE SAME TERMINAL FOR COAXIAL CABLE

BACKGROUND OF THE INVENTION

1. Technical Field

The present invention relates to a terminal for coaxial cable for connecting a coaxial cable (coaxial cable to be used for an automobile glass antenna for example) to a circuit element on a base board (an antenna element on the surface of a glass board for example) and the like, and an attachment structure and an attachment method for attaching the same terminal for coaxial cable to a base board (an automobile glass board for example) and the like.

2. Prior Art

In case of connecting an end portion of a coaxial cable for transmitting a high-frequency signal with a base board, it is necessary to strip off coverings of the end portion of the coaxial cable and to connect a center conductor and an outer conductor respectively to specified portions of a circuit element on the base board.

Up to now, in case of attaching such an end portion of a coaxial cable directly to a circuit on a base board, a terminal for coaxial cable 31 as shown in FIG. 11 for example is used.

This terminal for coaxial cable 31 is formed by pressing and then bending a conductive plate material 31*a*, and is attached to a covering-stripped end portion 30A of a coaxial cable 30.

The terminal for coaxial cable 31 is formed so as to be nearly bilaterally symmetrical with respect to the axial line of the coaxial cable 30 and has a barrel portion 33 for clamping a folded-back portion 32A of a meshed wire of an outer conductor 32 at its rear portion, and this barrel portion 33 is composed of a pair of left and right clamping pieces 33A and 33B, both clamping pieces 33A and 33B being opened downward in an inverted U-shape in FIG. 11 in a state where the outer conductor 32 is not clamped.

An intrusive portion 34 is protruded inside the barrel portion 33 in the middle of the base parts of both clamping pieces 33A and 33B, and this intrusive portion 34 intrudes into the meshed wire of the outer conductor 32 to suppress the backward slippage in position of the coaxial cable 30.

And the terminal for coaxial cable 31 is attached to an end portion of the coaxial cable 30 by inserting and clamping the end portion of the coaxial cable 30 into the barrel portion 33 so that the fore-end edge of the folded-back portion 30A of the coaxial cable 30 does not touch the intrusive portion 34 by means of the clamping pieces 33A and 33B.

In such a way, after the terminal for coaxial cable 31 has been attached to the end portion of the coaxial cable 30, the outer conductor 32 is connected to a contact portion 38 by fitting a leg 35 of the terminal for coaxial cable 31 into a fitting hole 37 of a printed wiring board 36 and soldering the fore-end portion of the leg 35 at the reverse face side of the printed wiring board 36. The center conductor 39 of the coaxial cable 30 is soldered to a contact portion 36A of the printed wiring board 36 (see Patent Literature 1: Japanese Patent Laid-Open Publication No. 2000-323,213).

And FIG. 12 shows another prior art as a coaxial cable connection structure for connecting a coaxial cable to a printed wiring board.

This coaxial cable connection structure provides a printed wiring board 40 with a slit 41, forms a strip line 42 on the extension of this slit 41, forms a grounding pattern 43 at both sides of the slit 41, fits an outer conductor 45 of a coaxial cable 44 in the slit 41, solders a center conductor 46 to the strip line 42 and solders the outer conductor 45 to the grounding pattern 43, holds down the outer conductor 45 with a cable clamp 47, and fixes this cable clamp 47 on the printed wiring board 40 (see Patent Literature 2: Japanese Patent Laid-Open Publication No. 2003-168,499).

For example, in a terminal for coaxial cable for connecting a coaxial cable to be used for an automobile glass antenna to an antenna element on the surface of an automobile glass board, it is very important to control the position of attachment of the terminal for coaxial cable.

That is to say, it is necessary not only to stably attach a center conductor and an outer conductor of the fore-end portion of a coaxial cable respectively to the same positions as determined in a terminal for coaxial cable but also to accurately and stably attach the center conductor and the outer conductor in position of attachment at a specified interval on a mounted object.

In a terminal for coaxial cable of the former prior art as described above, however, since a coaxial cable 30 is in a state where only an outer conductor 32 of it is fixed to the terminal for coaxial cable 31, there has been a problem that it is difficult to stably attach the center conductor and the outer conductor of the fore-end portion of the coaxial cable 30 respectively to the same positions as determined on a base board and to accurately and stably attach the center conductor and the outer conductor to the same positions as determined with respect to the interval between them.

And since the outer conductor 32 is connected to the contact portion 38 by clamping the folded-back portion 32A of a meshed wire being the outer conductor 32 of the coaxial cable 30 with the clamping pieces 33A and 33B of the barrel portion 33 of the terminal for coaxial cable 31, fitting the leg 35 in the fitting hole 37 of the printed wiring board 36, and soldering the fore-end portion of the leg 35 at the reverse face side of the base board 36, the coaxial cable 30 is in a state where only its outer conductor 32 is fixed to the terminal for coaxial cable 31. Due to this, there has been a problem that in case that a load is applied to the coaxial cable 30 particularly in a period from a time when the coaxial cable has been press-joined to a time when the mounting is finished by soldering an element on the base board, the whole load applied to the coaxial cable 30 is applied to the barrel portion 33 being the press-joined portion and thereby the barrel portion 33 is broken.

Also in case of using a coaxial cable connection structure of the latter prior art as described above for an automobile glass antenna, there has been a problem that it is difficult to stably attach the center conductor and the outer conductor of the fore-end portion of a coaxial cable respectively to the same positions as determined and to accurately and stably attach the center conductor and the outer conductor to the same positions as determined with respect to the interval between them.

And due to soldering the center conductor 46 of a coaxial cable 44 to a strip line 42, soldering the outer conductor 45 to a grounding pattern 43, holding down the outer conductor 45 with a cable clamp 47, and fixing this cable clamp 47 to a printed wiring board 40, there has been a problem that in case that a load is applied to the coaxial cable 44, the whole load applied to the coaxial cable 44 is applied to the cable clamp 47 and thereby the cable clamp 47 or the coaxial cable 44 is broken. Using a terminal for coaxial cable having a housing of insulator is also conceivable but is disadvantageous for miniaturization.

And there has been a problem that a hole or a slit must be provided in a printed wiring board. For example, in case of using such a terminal for coaxial cable for an antenna element on the surface of an automobile glass board, there has been a problem of being unable to make a hole in the board and solder on the reverse face or provide a slit.

The present invention has been performed in order to solve the above-described problems, and a first object of the invention is to provide a terminal for coaxial cable making it possible to stably attach a center conductor and an outer conductor of the fore-end portion of a coaxial cable respectively to the same positions as determined, accurately and stably attach the center conductor and the outer conductor to the same positions as determined on a mounted object also with respect to the interval between them, reduce a load applied to cable connection portions (a center conductor press-joined portion and an outer conductor press-joined portion) in a period from a time when the center conductor and the outer conductor have been press-joined to a time when the mounting is finished by soldering an element on the board and prevent the cable connection portion from being broken, said terminal for coaxial cable having no need for providing a hole or a slit in the printed wiring board.

And a second object of the invention is to provide an attachment structure of a terminal for coaxial cable making it possible to stably attach a center conductor and an outer conductor respectively to the same positions as determined on a mounted object (for example, an antenna element on the surface of an automobile glass board), accurately and stably attach the center conductor and the outer conductor to the same positions as determined also with respect to the interval between them, reduce a load to be applied to the cable connection portion (center conductor press-joined portion and outer conductor press-joined portion) in a period from a time when the center conductor and the outer conductor have been press-joined to a time when the mounting is finished by soldering an element on the board and prevent the cable connection portion from being broken, said terminal for coaxial cable having no need for providing a hole or a slit in the printed wiring board.

And a third object of the invention is to provide a method for attaching a terminal for coaxial cable making it possible to stably attach a center conductor and an outer conductor respectively to the same positions as determined on a mounted object (for example, an antenna element on the surface of an automobile glass board), accurately and stably attach the center conductor and the outer conductor to the same positions as determined with respect to the interval between them, reduce a load applied to cable connection portions (a center conductor press-joined portion and an outer conductor press-joined portion) in a period from a time when the center conductor and the outer conductor have been press-joined to a time when the mounting is finished by soldering an element on the board and prevent the cable connection portion from being broken, said terminal for coaxial cable having no need for providing a hole or a slit in the printed wiring board.

BRIEF SUMMARY OF THE INVENTION

In order to attain said first object, a terminal for coaxial cable according to claim 1 of this application is a terminal for coaxial cable for mounting a coaxial cable having a center conductor and an outer conductor on a mounted object, said terminal for coaxial cable being characterized in that it comprises a center conductor connecting portion to be connected to the center conductor and to be mounted on the mounted object and an outer conductor connecting portion to be connected to the outer conductor and to be mounted on the mounted object, wherein the center conductor connecting portion and the outer conductor connecting portion are connected to each other by a joint portion being able to be cut off.

And a terminal for coaxial cable according to claim 2 of this application is characterized by a terminal for coaxial cable according to claim 1 of this application, wherein said center conductor connecting portion comprises a center conductor press-joining portion for press-joining the center conductor and a center conductor side grounding portion which leads to this center conductor press-joining portion and is to be in contact with the mounted object, and said outer conductor connecting portion comprises an outer conductor press-joining portion for press-joining the outer conductor and an outer conductor connection side grounding portion which leads to this outer conductor press-joining portion and is to be in contact with the mounted object.

Therefore, according to a terminal for coaxial cable as defined in claim 1 or 2 of this application, since the center conductor connecting portion and the outer conductor connecting portion are joined to each other by the joint portion, it is possible to stably attach the center conductor and the outer conductor of a coaxial cable respectively to the same positions as determined in the terminal for coaxial cable, and to accurately and stably attach the center conductor and the outer conductor to the same positions determined on the mounted object also with respect to the interval between them. Further, there is an advantage of making it possible to solder both the center conductor connecting portion and the outer conductor connecting portion to the mounted object without twisting them, perform collectively mounting and make the mounting easy compared with the terminal wherein grounding portions are mounted respectively.

Furthermore, since the center conductor connecting portion and the outer conductor connecting portion are joined to each other by the joint portion, in case of mounting the center conductor connecting portion and the outer conductor connecting portion on the mounted object, even if a load is applied to the coaxial cable in a period from a time when the center conductor and the outer conductor have been press-joined to a time when the mounting is finished by soldering an element on the board, the load applied to the coaxial cable is shared between the coaxial cable connecting portion (center conductor press-joining portion for example) of the center conductor connecting portion and the coaxial cable connecting portion (outer conductor press-joining portion for example) of the outer conductor connecting portion, and due to this it is possible to reduce the load applied to these cable connecting portions and prevent the cable connecting portion from being broken. Still further, it is unnecessary to provide a hole or a slit in a printed wiring board.

And a terminal for coaxial cable according to claim 3 of this application is characterized by a terminal for coaxial cable according to claim 2 of this application, wherein the center conductor side grounding portion comprises a center conductor side grounding piece to be in contact with the mounted object, the outer conductor side grounding portion comprises an outer conductor side grounding piece to be in contact with the mounted object, the joint portion comprises at least one joint piece, and said joint piece joins the center conductor side grounding piece and the outer conductor grounding piece to each other.

Therefore, according to a terminal for coaxial cable as defined in claim 3 of this application, the center conductor side grounding portion and the outer conductor side grounding portion can be separated by bringing a contact portion of the center conductor side grounding piece into contact with one contact portion on the mounted object, bringing a contact portion of the outer conductor side grounding piece into contact with the other contact portion on the mounted object, soldering them respectively and thereby mounting the terminal for coaxial cable on the mounted object, and thereafter snapping off the joint piece.

And a terminal for coaxial cable according to claim 4 of this application is characterized by a terminal for coaxial cable according to claim 3 of this application, wherein a cutoff groove portion is formed at the border between the center conductor side grounding piece and/or the outer conductor side grounding piece and the joint piece.

Therefore, according to a terminal for coaxial cable as defined in claim 4 of this application, it is possible to make the joint piece easy to be cut off at the cutoff groove portion.

In order to attain said second object, an attachment structure of a terminal for coaxial cable according to claim 5 of this application is characterized by an attachment structure of a terminal for coaxial cable for mounting a coaxial cable having a center conductor and an outer conductor on a mounted object, wherein the terminal for coaxial cable comprises a center conductor connecting portion to be connected to the center conductor and to be mounted on the mounted object and an outer conductor connecting portion to be connected to the outer conductor and to be mounted on the mounted object, said center conductor connecting portion and said outer conductor connecting portion being connected to each other by a joint portion at least before being mounted on the mounted object, the center conductor connecting portion comprises a center conductor press-joining portion for press-joining the center conductor and a center conductor side grounding portion which leads to this center conductor press-joining portion and is to be in contact with the mounted object, the outer conductor connecting portion comprises an outer conductor press-joining portion for press-joining the outer conductor and an outer conductor side grounding portion which leads to this outer conductor press-joining portion and is to be in contact with the mounted object, and the coaxial cable and the terminal for coaxial cable attach the center conductor to the center conductor press-joining portion by press-joining and attach the outer conductor to the outer conductor press-joining portion by press-joining and attach and mount the center conductor side grounding portion and the outer conductor side grounding portion onto the mounted object, and the interval between the center conductor side grounding portion and the outer conductor side grounding portion is the same as the interval between those of the terminal for coaxial cable before being mounted.

Therefore, according to an attachment structure of a terminal for coaxial cable as defined in claim 5 of this application, since the center conductor side grounding portion and the outer conductor side grounding portion are respectively mounted on the mounted object in state where the center conductor conducting portion and the outer conductor connecting portion are joined to each other by the joint portion, it is possible to obtain a structure making it possible to stably attach a center conductor and an outer conductor of the fore-end portion of a coaxial cable respectively to the same positions as determined, and to accurately and stably attach the center conductor and the outer conductor to the same positions as determined with respect to the interval between them on a mounted object, and therefore there can be obtained a structure suitable for an automobile glass antenna for example.

And an attachment structure of a terminal for coaxial cable according to claim 6 of this application is characterized by an attachment structure of a terminal for coaxial cable according to claim 5 of this application, wherein the mounted object has conductor portions and their edges being distant from each other by a specified interval between them, and the terminal for coaxial cable is attached to the mounted object so that an end portion of the center conductor connecting portion closer to the outer conductor connecting portion and an end portion of the outer conductor connecting portion closer to the center conductor connecting portion are arranged on areas in the conductor portions, said areas being sufficiently distant from the edges of the conductor portions.

Therefore, according to an attachment structure of a terminal for coaxial cable as defined in claim 6 of this application, since an end portion of the center conductor connecting portion closer to the outer conductor connecting portion and an end portion of the outer conductor connecting portion closer to the center conductor connecting portion are sufficiently distant from the edges of conductor portions, even if solder overflows from each grounding portion, there is not the possibility that the solder goes beyond the edge of each conductor portion and influences the electric characteristics of the mounted object.

And an attachment structure of a terminal for coaxial cable according to claim 7 of this application is characterized by an attachment structure of a terminal for coaxial cable according to claim 5 or 6 of this application, wherein the mounted object is an automobile glass board provided with an antenna element on the surface of it.

Therefore, according to an attachment structure of a terminal for coaxial cable as defined in claim 7 of this application, since a structure making it possible to stably attach a center conductor and an outer conductor of the fore-end portion of a coaxial cable respectively to the same positions as determined on an automobile glass board provided with an antenna element on the surface of it is obtained by using a terminal for coaxial cable of the present invention, it is possible to obtain a structure suitable for an automobile glass antenna.

In order to attain said third object, a method for attaching a terminal for coaxial cable according to claim 8 of this application is characterized by a method for attaching a coaxial cable having a center conductor and an outer conductor to a terminal for coaxial cable and attaching said terminal for coaxial cable to a mounted object, said terminal for coaxial cable comprising a center conductor connecting portion to be connected to a center conductor and to be mounted on the mounted object, an outer conductor connecting portion to be connected to an outer conductor and to be mounted on the mounted object and a joint portion joining the center conductor connecting portion and the outer conductor connecting portion to each other and capable of being cut off, wherein said method comprises a process of attaching the center conductor to the center conductor connecting portion and attaching the outer conductor to the outer conductor connecting portion, a process of attaching the center conductor connecting portion and the outer conductor connecting portion to the mounted object, and a process of removing the joint portion after the mounting process.

Therefore, according to a method for attaching a terminal for coaxial cable as defined in claim 8 of this application, since a center conductor connecting portion and an outer conductor connecting portion are mounted on a mounted object in state where the center conductor conducting portion and the outer conductor connecting portion are joined to each other by a joint portion, it is possible to keep constant the interval between the center conductor connecting portion and the outer conductor connecting portion. Further, since the fore-end portion of a coaxial cable is attached to a center conductor connecting portion and an outer conductor connecting portion of a terminal for coaxial cable in a state where the center conductor connecting portion and the outer conductor connecting portion are joined to each other by a joint portion and/or a state where they are attached to a mounted object, it is possible to keep constant the interval between the positions at which a coaxial cable is attached to the center conductor connecting portion and the outer conductor connecting portion. And in case of attaching a coaxial cable to a terminal for coaxial cable and then attaching said terminal for coaxial cable to a mounted object, since a center conductor connecting portion and an outer conductor connecting portion are joined to each other by a joint portion, even if a load is applied to the coaxial cable in a period from a time when the coaxial cable has been attached to the terminal for coaxial cable to a time when said terminal for coaxial cable is attached to a mounted object, the load applied to the coaxial cable is shared between the coaxial cable connecting portion of the center conductor connecting portion and the coaxial cable connecting portion of the outer conductor connecting portion, and due to this it is possible to reduce a load to be applied to each connecting portion and prevent breakage.

BEST MODE FOR CARRYING OUT THE INVENTION

Although embodiments of the present invention are described with reference to the drawings in the following, the present invention is not limited to these embodiments at all.

Embodiment 1

Figure 1:
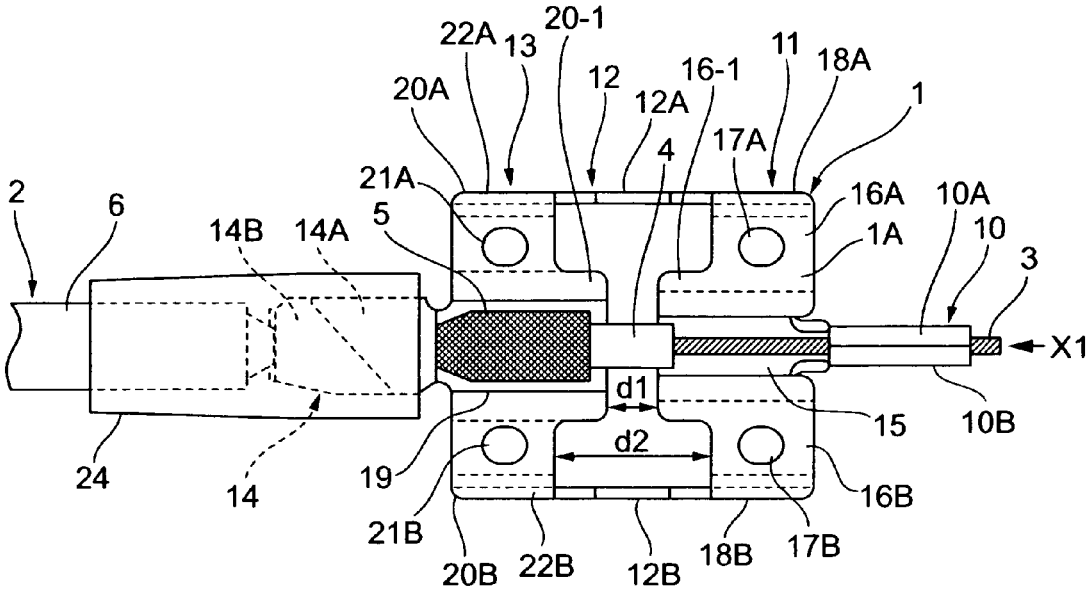
FIG. 1 is a plan view of a terminal for coaxial cable (embodiment 1) according to the present invention having a coaxial cable attached to it in a state where a center conductor side grounding portion and an outer conductor side grounding portion are joined to each other by a joint portion.
Figure 2:
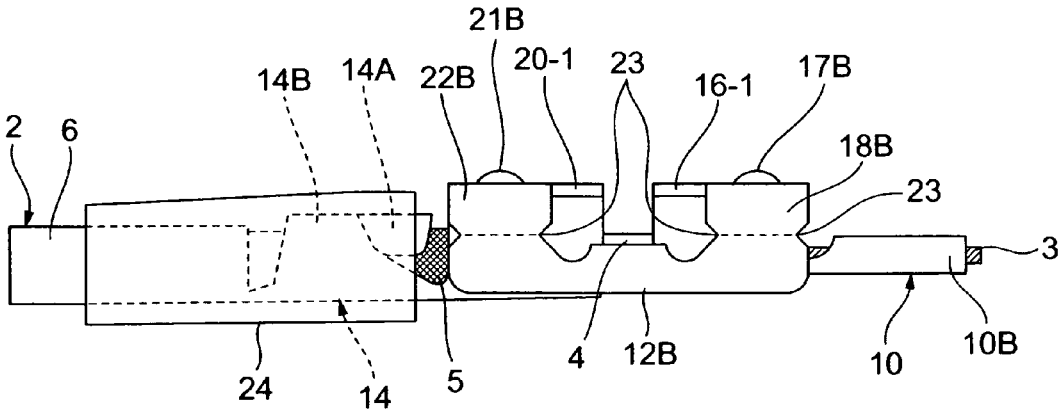
FIG. 2 is a side view of the same terminal for coaxial cable.
Figure 3:
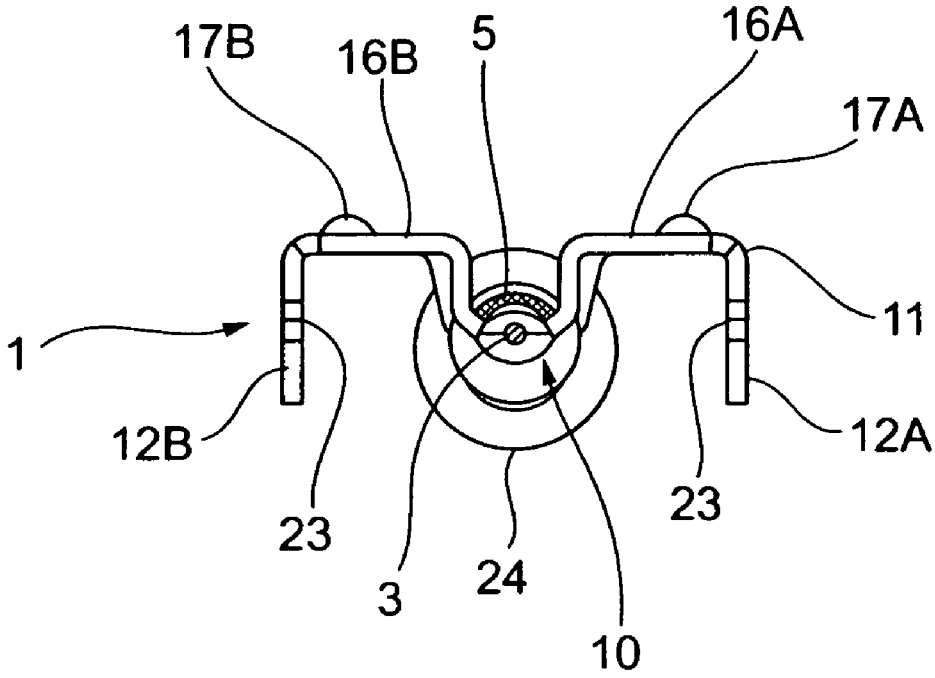
FIG. 3 is a view in the direction of arrow X1 in FIG. 1.

FIGS. 1 to 6 show embodiment 1 of the present invention. FIG. 1 is a plan view of a terminal for coaxial cable according to the present invention having a coaxial cable attached to it in a state where a center conductor side grounding portion 11 and an outer conductor side grounding portion 13 are joined to each other by a joint portion 12, FIG. 2 is a side view of the terminal for coaxial cable in FIG. 1, and FIG. 3 is a view in the direction of arrow X1 in FIG. 1. The description of embodiment 1 of the present invention assumes that an end portion where a center conductor 3 of a coaxial cable 2 is exposed is the fore-end portion. as a whole and has a center conductor 3 in its center, and this center conductor is covered with an inner covering 4 and this inner covering is surrounded by an outer conductor 5 formed out of meshed wire, the outside of which is covered with an outer covering 6 being the outermost layer.

And at an end portion to which a terminal for coaxial cable 1 is to be joined, the outer covering 6 is stripped off and the exposed outer conductor 5 is folded back so as to adhere closely to the outer circumferential face of the outer covering 6. And the exposed inner covering 4 is stripped off at the front position and the center conductor 3 protrudes from the fore-end face of the inner covering 4.

The terminal for coaxial cable 1 is formed by blanking out and then bending a conductive plate material, and is made laterally nearly symmetrical with respect to the axial line of a coaxial cable 2. Hereupon, as a conductive plate material, there is preferably used a metal plate material such as copper, brass, phosphor bronze and the like for example, said metal plate material having a surface treatment of plating and the like performed on it according to need. And the terminal for coaxial cable 1 comprises a center conductor press-joining portion 10, a center conductor side grounding portion 11, a joint portion 12, an outer conductor side grounding portion 13 and an outer conductor press-joining portion 14 in order from the front toward the rear, and the center conductor press-joining portion 10 and the center conductor side grounding portion 11 form a center conductor connecting portion and the outer conductor press-joining portion 14 and the outer conductor side grounding portion 13 form an outer conductor connecting portion.

The center conductor side grounding portion 11 has a groove portion 15 being semicircular arc-shaped in section and being located at the middle of it and a pair of left and right grounding pieces (one and the other center conductor side grounding pieces) 16A and 16B being located at both sides of the groove portion 15, and contact portions 17A and 17B protruding upward in FIG. 2 are formed respectively in the middles of these grounding pieces 16A and 16B. And bent portions 18A and 18B bent downward nearly perpendicularly to the flat faces of the grounding pieces 16A and 16B are formed at the outer ends of the grounding pieces 16A and 16B. And a projection 16-1 is formed in the middle of the rear end portion of the center conductor side grounding portion 11 so as to stretch over the grounding pieces 16A and 16B.

And the center conductor side grounding portion 11 leads to the center conductor press-joining portion 10 at the fore-end of the groove portion 15, and this center conductor press-joining portion 10 is formed out of a pair of left and right press-joining pieces 10A and 10B. The press-joining pieces 10A and 10B are opened in U-shape for example in a state where the center conductor 3 is not clamped by them.

And the outer conductor side grounding portion 13 has a groove portion 19 being semicircular arc-shaped in section and being located at the middle of it and a pair of left and right grounding pieces (one and the other outer conductor side grounding pieces) 20A and 20B, and contact portions 21A and 21B protruding upward in FIG. 2 are formed respectively in the middles of these grounding pieces 20A and 20B. And bent portions 22A and 22B bent downward nearly perpendicularly to the flat faces of the grounding pieces 20A and 20B are formed at the outer ends of the grounding pieces 20A and 20B. And a projection 20-1 is formed in the middle of the front end portion of the outer conductor side grounding portion 13 so as to stretch over the grounding pieces 20A and 20B.

And the outer conductor side grounding portion 13 leads to the outer conductor press-joining portion 14 at the rear end of the groove portion 19, and this outer conductor press-joining portion 14 is formed out of a pair of left and right press-joining pieces 14A and 14B. The press-joining pieces 14A and 14B are opened in U-shape for example in a state where the outer conductor 3 is not clamped by them.

And the center conductor side grounding portion 11 and the outer conductor side grounding portion 13 are connected to each other by the joint portion 12. That is to say, the joint portion 12 has a pair of left and right (one and the other) joint pieces 12A and 12B, and the joint piece 12A connects the bent portion 18A of the grounding piece 16A of the center conductor side grounding portion 11 and the bent portion 22A of the grounding piece 20A of the outer conductor side grounding portion 13 to each other, and has cutoff groove portions 23 formed at both ends of each of the borders between the joint piece 12A and the bent portion 18A and between the joint portion 12A and the bent portion 22A so as to shorten the length of each border.

And the joint piece 12B connects the bent portion 18B of the grounding piece 16B of the center conductor side grounding portion 11 and the bent portion 22B of the grounding piece 20B of the outer conductor side grounding portion 13 to each other, and has cutoff groove portions 23 formed at both ends of each of the borders between the joint piece 12B and the bent portion 18B and between the joint portion 12B and the bent portion 22B so as to shorten the length of each border. The joint pieces 12A and 12B can be broken off by hand or by means of a tool such as a nipper and the like. And they may be made easier to be broken off by forming a straight groove of about 0.05 mm in each border. If the joint portion 12 is formed out of an insulating material, the joint portion 12 does not necessarily need to be cut off after it is mounted on a mounted object.

And as shown in FIG. 1, the distance d1 between the projection 16-1 formed at the rear end of the center conductor side grounding portion 11 of the center conductor connecting portion and the projection 20-1 formed at the front end of the outer conductor side grounding portion 13 of the center conductor connecting portion is made smaller than the distance d2 at the contact portions (17A, 17B), (21A, 21B) side between the grounding pieces (center conductor side grounding pieces) 16A, 16B of the center conductor side grounding portion 11 and the grounding pieces (outer conductor side grounding pieces) 20A, 20B of the outer conductor side grounding portion 13.

In case of mounting a terminal for coaxial cable of embodiment 1 on a mounted object (automobile glass board for example) having conductor portions (a center conductor grounding side conductor portion F and an outer conductor grounding side conductor portion G) being distant from each other with a specified interval between them, a terminal structure being excellent in stability and controllability of electric characteristics can be obtained by mounting the terminal for coaxial cable on the mounted object (automobile glass board for example) so that the distance d1 between the projection 16-1 and the projection 20-1 is made smaller than the interval between the conductor portions (the center conductor grounding side conductor portion F and the outer conductor grounding side conductor portion G) and so that the end portions of the projection 16-1 and the projection 20-1, said end portions facing each other, come to be over the space separating the conductor portions (the center conductor grounding side conductor portion F and the outer conductor grounding side conductor portion G) from each other. It is appropriate that the distance between the center conductor connecting portion and the outer conductor connecting portion is made to be about 1 to 15 mm.

Next, a method of attaching a terminal for coaxial cable 1 formed as described above to a coaxial cable 2 and a method of mounting the terminal for coaxial cable 1 on an automobile glass board provided with an antenna element on the surface of it, said automobile glass board being a mounted object, are described.

First, a coaxial cable 2 is inserted through into a thermo-contractive tube 24 in advance, and then the tube 24 is made to be distant from an end portion where the coverings of this coaxial cable 2 have been stripped off.

And the stripped end portion of the coaxial cable 2 is inserted into a terminal for coaxial cable 1 in which a pair of left and right press-joining pieces 10A and 10B of a center conductor press-joining portion 10 and a pair of press-joining pieces 14A and 14B of an outer conductor press-joining portion 14 which are opened in U-shape for example.

That is to say, the center conductor 3 of the coaxial cable 2 is inserted between the press-joining pieces 10A and 10B of the center conductor press-joining portion 10, and the inner covering 4 and the center conductor 3 of the coaxial cable 2 are inserted into the groove portion 15 of the center conductor side grounding portion 11. And the outer conductor 5 of the coaxial cable 2 is inserted into the groove portion 19 and between the press-joining pieces 14A and 14B of the outer conductor press-joining portion 14.

And the terminal for coaxial cable 1 is attached to the end portion of the coaxial cable 2 by joining the center conductor 3 to the press-joining pieces 10A and 10B of the center conductor press-joining portion 10 by press-joining and joining the outer conductor 5 to the press-joining pieces 14A and 14B of the outer conductor press-joining portion 14 by press-joining.

In this state, since the outer conductor 5 and the outer covering 6 are clamped together by fastening the left press-joining piece 14A round the outer conductor 5 and then clamping the press-joining piece 14B from the back of the press-joining piece 14A, a function of preventing the outer conductor press-joining portion 14 from slipping off from the coaxial cable 2 is enhanced. And the thermo-contractive tube 24 which has had the coaxial cable 2 inserted into it in advance is moved to the outer conductor press-joining portion 14 to cover it and is contracted by performing a heat treatment.

Figure 4:
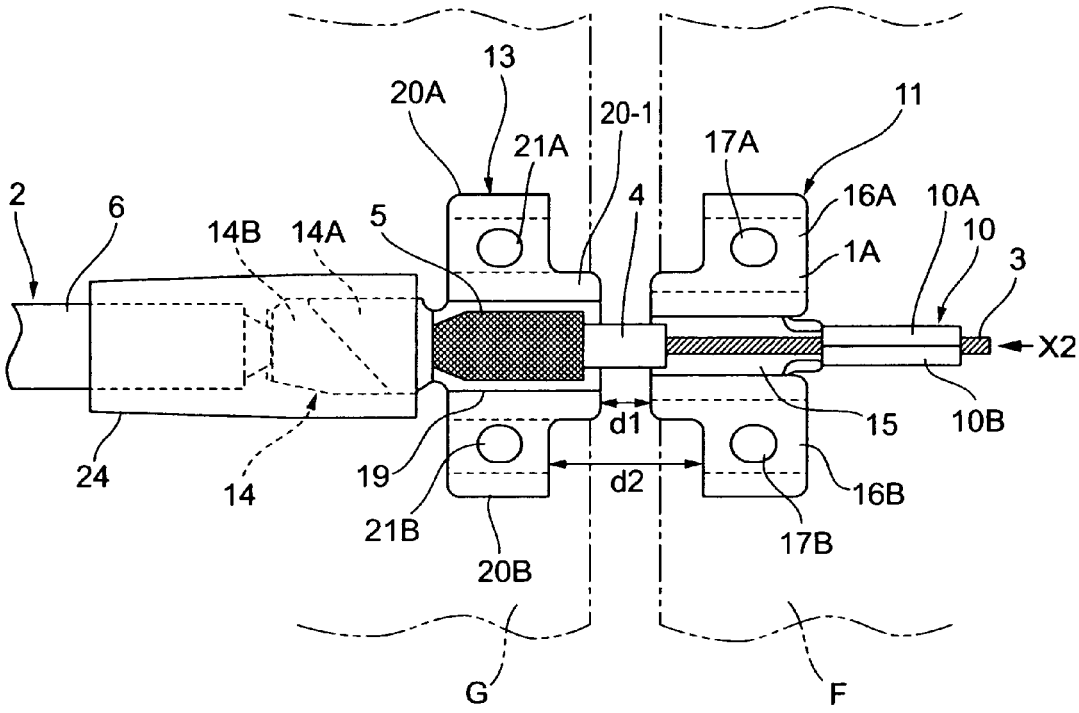
FIG. 4 is a plan view of a terminal for coaxial cable according to the present invention having a coaxial cable attached to it in a state where a center conductor side grounding portion and an outer conductor side grounding portion are cut off from each other.
Figure 5:
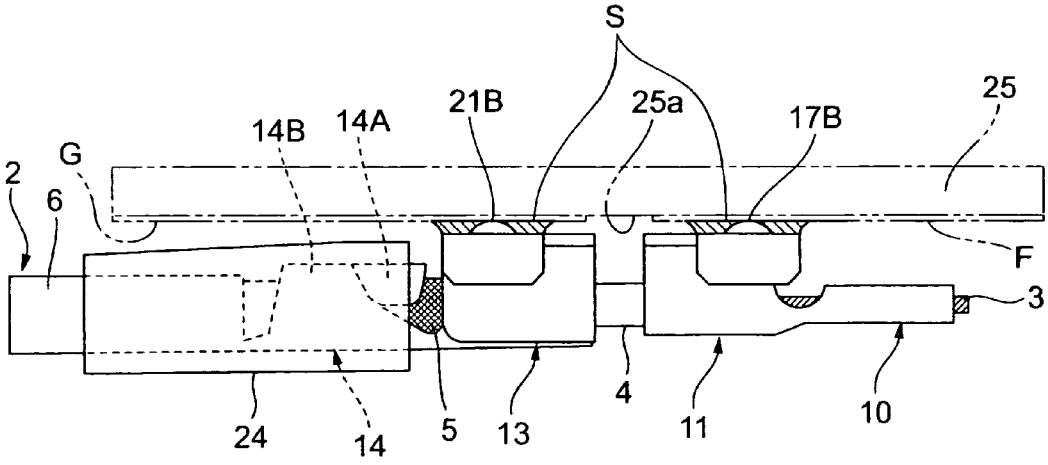
FIG. 5 is a side view of the same terminal for coaxial cable.
Figure 6:
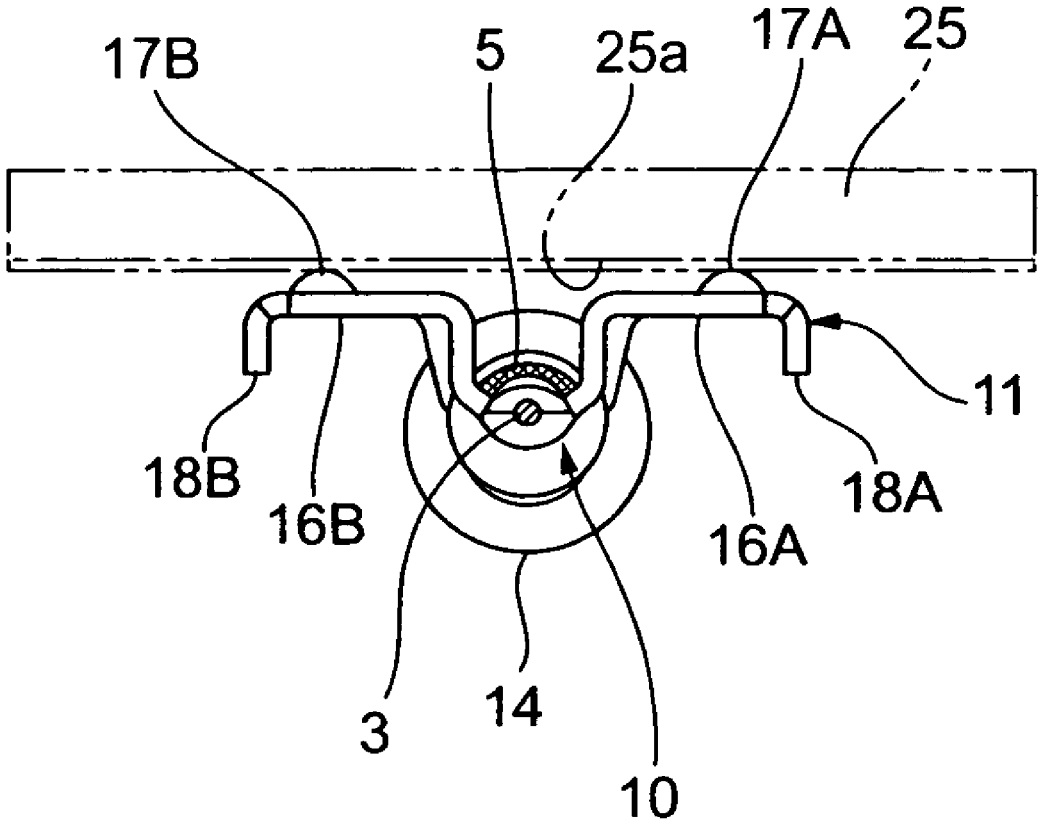
FIG. 6 is a view in the direction of arrow X2 in FIG. 4.

After the terminal for coaxial cable 1 has been attached to the end portion of the coaxial cable 2 as described above, this terminal for coaxial cable 1 is mounted on an automobile glass board 25 being a mounted object. The attachment to the automobile glass board 25 is performed by bringing the contact portions 17A and 17B shown in FIG. 4 into contact with the center conductor grounding side conductor portion F, bringing the contact portions 21A and 21B into contact with the outer conductor grounding side conductor portion G, and soldering the contact portions 16A, 16B and the contact portions 20A, 20B respectively to the center conductor grounding side conductor portion F and the outer conductor grounding side conductor portion G. Hereupon, the center conductor grounding side conductor portion F and the outer conductor grounding side conductor portion G are conductor portions being separated with a specified space between them in an antenna element provided on the surface of the automobile glass board 25 (on the glass board face 25*a*). The center conductor grounding side conductor portion F and the outer conductor grounding side conductor portion G may be conductors being independent of each other on the glass board face 25*a* and may be conductors partially separated by a slit and the like. FIG. 4 is a view of the terminal structure seen through the automobile glass board (not illustrated) and the antenna element, FIG. 5 is a side view of the terminal for coaxial cable and the mounted object, and FIG. 6 is a view in the direction of arrow X2 in FIG. 4.

After the mounting (fastening) by soldering the terminal for coaxial cable 1 to the glass board face 25*a* of the automobile glass board 25 has ended, the joint pieces 12A and 12B are broken off at the cutoff groove portions 23.

In such a way, the grounding piece 16A and the grounding piece 20A are separated from each other and the grounding piece 16B and the grounding piece 20B are separated from each other by breaking off the joint pieces 12A and 12B.

Due to this, there is obtained a structure in which the center conductor side grounding portion 11 and the outer conductor side grounding portion 13 are separated from each other in a terminal for coaxial cable 1, the center conductor 3 is mounted on the center conductor grounding side conductor portion F of an antenna element through the center conductor side grounding portion 11 and the outer conductor 5 is mounted on the outer conductor grounding side conductor portion G of the antenna element through the outer conductor side grounding portion 13.

Embodiment 2

FIGS. 7 to 10 show embodiment 2 of the present invention.

Figure 7:
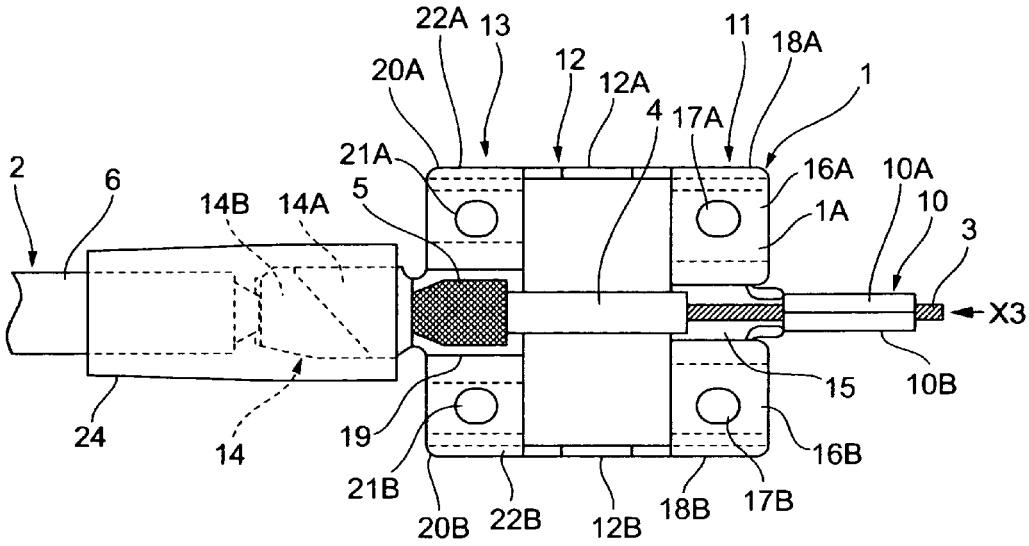
FIG. 7 is a plan view of a terminal for coaxial cable (embodiment 2) according to the present invention in a state where a center conductor side grounding portion and an outer conductor side grounding portion are joined to each other by a joint portion.
Figure 8:
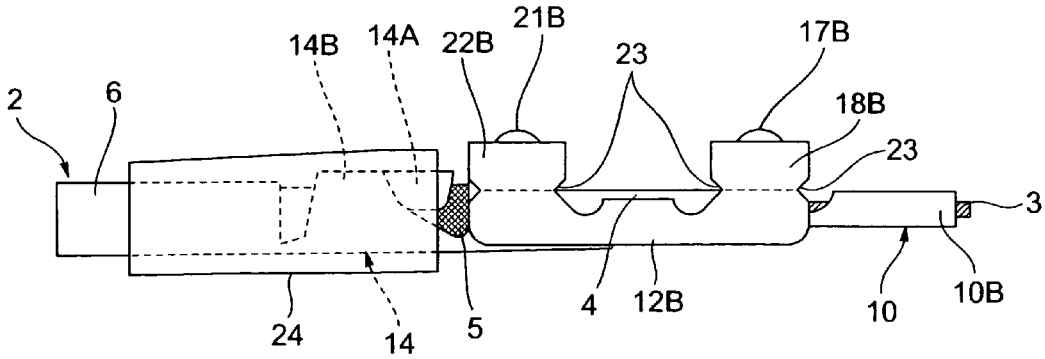
FIG. 8 is a side view of the same terminal for coaxial cable.

As shown in FIGS. 7 and 8, in embodiment 2 of the present invention, the projection 16-1 and the projection 20-1 in embodiment 1 of the present invention are removed and the end face of the center conductor grounding portion 11 closer to the outer conductor connecting portion and the end face of the outer conductor grounding portion 13 closer to the center conductor connecting portion are made to be in parallel with each other. Since the other configuration is the same as that of embodiment 1 of the present invention described above, the same symbols are used and the description of it is omitted. And since a method of attaching a coaxial cable 2 to a terminal for coaxial cable 1 and mounting the terminal for coaxial cable 1 to a mounted object (automobile glass board for example) is also the same as embodiment 1 of the present invention, the description of it is omitted.

Figure 9:
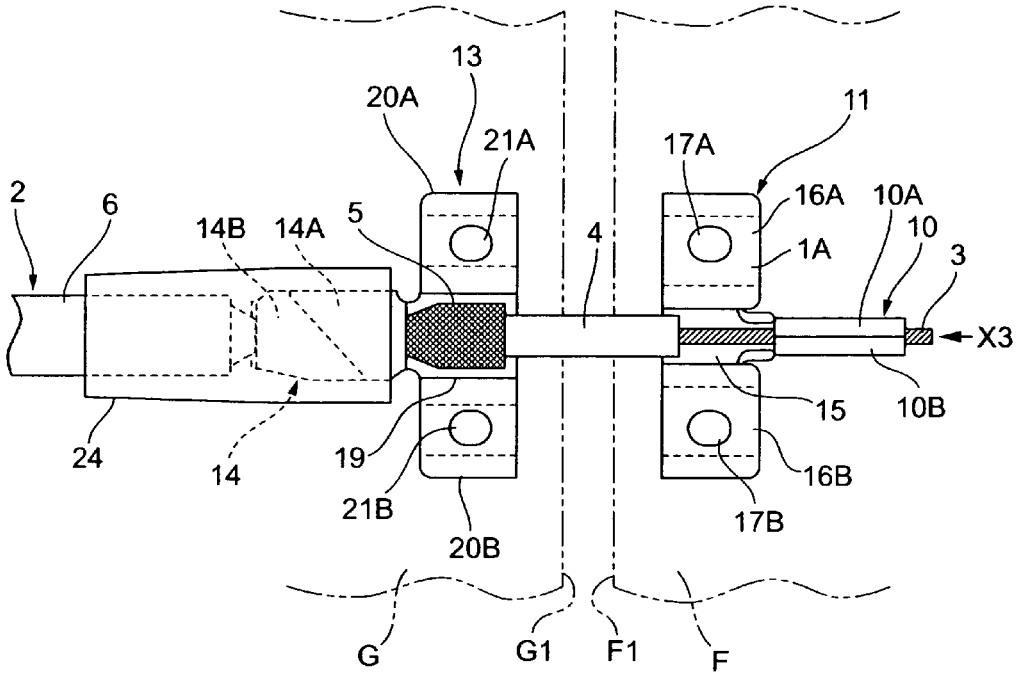
FIG. 9 is a plan view of a terminal for coaxial cable according to the present invention having a coaxial cable attached to it in a state where a center conductor side grounding portion and an outer conductor side grounding portion are cut off from each other.
Figure 10:
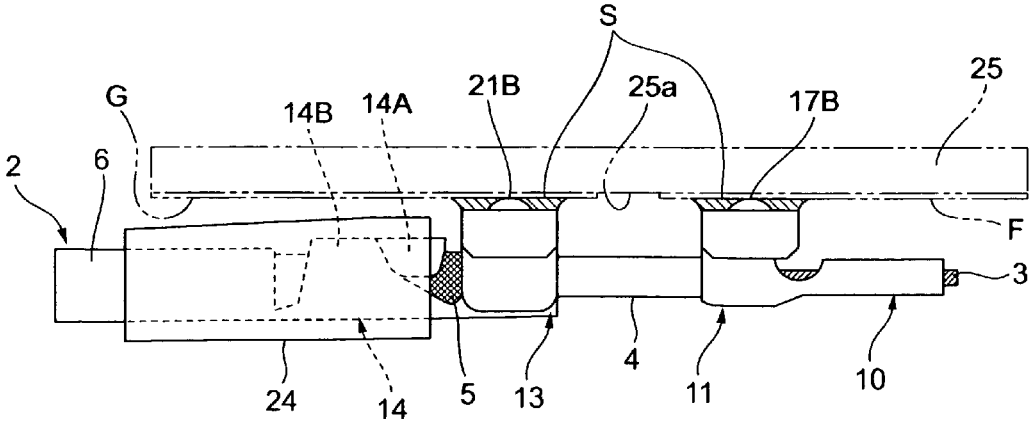
FIG. 10 is a side view of the same terminal for coaxial cable.
Figure 11:
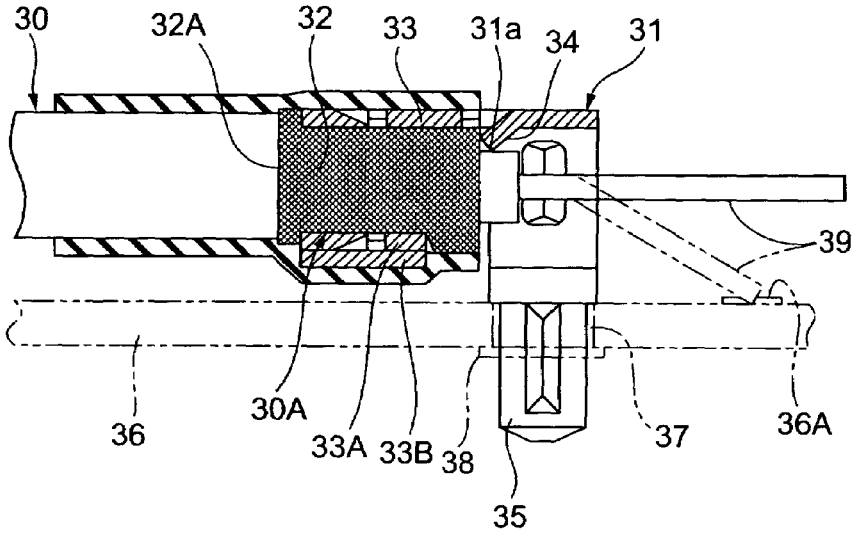
FIG. 11 is a longitudinal sectional view of a conventional terminal for coaxial cable.
Figure 12:
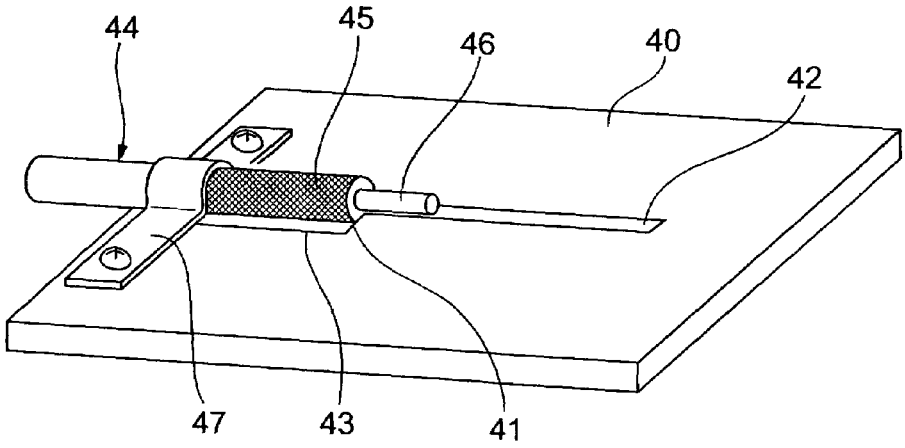
FIG. 12 is a perspective view of a conventional coaxial cable connection structure.

In case of mounting a terminal for coaxial cable 1 of embodiment 2 of the present invention on a mounted object (automobile glass board 25) having conductor portions (a center conductor grounding side conductor portion F and an outer conductor grounding side conductor portion G) being distant from each other with a specified space between them, as shown in FIG. 9, center conductor side grounding pieces 16A and 16B are mounted on an area in a center conductor grounding side conductor portion F, said area being sufficiently distant from an edge portion F1 of the center conductor grounding side conductor portion F, and outer conductor side grounding pieces 20A and 20B are mounted on an area in an outer conductor grounding side conductor portion G said area being sufficiently distant from an edge portion G1 of the outer conductor grounding side conductor portion G.

Therefore, even if solder overflows from the grounding pieces 16A, 16B, 20A and 20B, there is not the possibility that the solder goes beyond the edge portions F1 and G1 of the respective conductor portions (the center conductor grounding side conductor portion F and the outer conductor grounding side conductor portion G), and the electric characteristic of an antenna element is determined by the distance between the edge portions F1 and G1 of the respective conductor portions (the center conductor grounding side conductor portion F and the outer conductor grounding side conductor portion G) and is not influenced by the overflow of solder. In this case, "being sufficiently distant" means being distant by a distance at which there is not the possibility that solder goes beyond the edge portions F1 and G1 of the respective conductor portions (the center conductor grounding side conductor portion F and the outer conductor grounding side conductor portion G) as shown in FIG. 9, even if the position of soldering is slipped in front or in rear or the solder S overflows from the grounding pieces 16A, 16B, 20A or 20B.

INDUSTRIAL APPLICABILITY

A terminal for coaxial cable according to the present invention makes it possible to stably attach a center conductor and an outer conductor of the fore-end of a coaxial cable respectively to the same positions as determined in the terminal for coaxial cable and to accurately and to stably mount the center conductor and the outer conductor to the same positions as determined also with respect to the interval between them on a mounted object. And in case of mounting a center conductor connecting portion and an outer conductor connecting portion on a mounted object, particularly even if a load is applied to a coaxial cable in a period from a time when the coaxial cable has been press-joined to the center conductor connecting portion and the outer conductor connecting portion to a time when the mounting is finished by soldering an element on a base board, the load applied to the coaxial cable comes to be shared between a coaxial cable connecting portion (center conductor press-joining portion for example) of the center conductor connecting portion and a coaxial cable connecting portion (outer conductor press-joining portion for example) of the outer conductor connecting portion and thereby the loads applied to these coaxial cable connecting portions can be reduced, and due to this it is possible to prevent the cable connecting portions from being broken, and therefore a terminal for coaxial cable of the invention is useful as a terminal for coaxial cable and the like for connecting a coaxial cable (coaxial cable to be used for an automobile glass antenna for example) to a circuit element on a base board (an antenna element on a glass board surface for example).

What is claimed is:

1. A terminal for coaxial cable for mounting a coaxial cable having a center conductor and an outer conductor on a mounted object, wherein said terminal for coaxial cable comprises:

a center conductor connecting portion arranged coaxially with respect to said coaxial cable to be connected to said center conductor;

an outer conductor connecting portion arranged coaxially with respect to said coaxial cable to be connected to said outer conductor; and a joint portion for detachably connecting said center conductor connecting portion and said outer conductor connecting portion, said center conductor connecting portion comprising:

a center conductor press-joining portion for press-joining said center conductor;

a pair of center-conductor side grounding pieces which lead to said center conductor press-joining portion and which are arranged symmetrically with the axis of said coaxial cable between them and in contact with the surface of said mounted object; and a center-conductor side bent portion in which an outer end of said center-conductor side grounding piece is bent perpendicularly with respect to a surface portion of said center-conductor side grounding piece, said outer conductor connecting portion comprising:

an outer conductor press-joining portion for press-joining said outer conductor;

a pair of outer-conductor side grounding pieces which lead to said outer conductor press-joining portion and which are arranged symmetrically with the axis of said coaxial cable between them and in contact with the surface of said mounted object; and an outer-conductor side bent portion which an outer end of said outer-conductor side grounding piece is bent perpendicularly with respect to a surface portion of said outer-conductor grounding piece, and said joint portion comprises:

a first joint piece for connecting one center-conductor side bent portion of said pair of center-conductor side bent portions and one outer-conductor side bent portion of said pair of outer-conductor side bent portions to each other in the axial direction of said coaxial cable; and a second joint piece for connecting the other center-conductor side bent portion of said pair of center-conductor side bent portions and the other outer-conductor side bent portion of said pair of outer-conductor side bent portions to each other in the axial direction of said coaxial cable.

2. A terminal for coaxial cable in claim 1, wherein a cutoff groove portion is formed in a border between said center-conductor side bent portion and said joint piece and in a border between said outer-conductor side bent portion and said joint piece, respectively.

3. An attachment structure of a terminal for coaxial cable for mounting a coaxial cable having a center conductor and an outer conductor on a mounted object, wherein said terminal for coaxial cable comprises;

a center conductor connecting portion arranaed coaxially with respect to said coaxial cable to be connected to said center conductor;

an outer conductor connecting portion arranged coaxially with respect to said coaxial cable to be connected to said outer conductor; and a joint portion for detachably connecting said center conductor connecting portion and said outer conductor connecting portion, said center conductor connecting portion comprising:

a center conductor press-joining portion for press-joining said center conductor;

a pair of center-conductor side grounding pieces which leads to said center conductor press-joining portion and is arranged symmetrically with the axis of said coaxial cable between them and in contact with the surface of said mounted object; and a center-conductor side bent portion in which an outer end of said center-conductor side grounding piece is bent perpendicularly with respect to a surface portion of said center-conductor side grounding piece, said outer conductor connecting portion comprises:

an outer conductor press-joining portion for press-joining said outer conductor;

a pair of outer-conductor side grounding pieces which lead to said outer-conductor press-joining portion and which are arranged symmetrically with the axis of said coaxial cable between them and in contact with the surface of said mounted object; and an outer-conductor side bent portion in which an outer end of said outer-conductor side grounding piece is bent perpendicularly with respect to a surface portion of said outer-conductor side grounding piece, and said joint portion comprises:

a first joint piece for connecting one center-conductor side bent portion of said pair of center-conductor side bent portions and one outer- conductor side bent portion of said pair of outer-conductor side bent portions to each other in the axial direction of said coaxial cable; and a second joint piece for connecting the other center-conductor side bent portion of said pair of center-conductor side bent portions and the other outer-conductor side bent portion of said pair of outer-conductor side bent portions to each other in the axial direction of said coaxial cable, wherein said coaxial cable is attached to said terminal for coaxial cable by press-joining the center conductor of said coaxial cable with said center conductor press-joining portion of said center conductor connecting portion and by press-joining the outer conductor of said coaxial cable with said outer conductor press-joining portion of said outer conductor connecting portion, wherein said center-conductor side grounding piece of said center conductor connecting portion and said outer-conductor side grounding piece of said outer conductor connecting portion are mounted on the surface of said mounted object, and wherein an interval between said center conductor connecting portion and said outer conductor connecting portion of said terminal for coaxial cable mounted on the surface of said mounted object is the same as the interval between said center conductor connecting portion and said outer conductor connecting portion before mounting.

4. An attachment structure of a terminal for coaxial cable according to claim 3, wherein said mounted object is an automobile glass board being provided with an antenna element on the surface of the automobile glass board.

5. An attachment structure of a terminal for coaxial cable according to claim 3, wherein said mounted object has conductor portions and their edge portions being distant from each other by a specified interval between them, and said terminal for coaxial cable is mounted on said mounted object so that an end portion of said center conductor connecting portion closer to said outer conductor connecting portion and an end portion of said outer conductor connecting portion closer to said center conductor portion are arranged on areas in said conductor portions, said areas being sufficiently distant from said edge portions of said conductor portions.

6. An attachment structure of a terminal for coaxial cable according to claim 5, wherein said mounted object is an automobile glass board being provided with an antenna element on the surface of the automobile glass board.

7. A method for attaching a coaxial cable having a center conductor and an outer conductor to a terminal for coaxial cable and mounting said terminal for coaxial cable on a mounted object, wherein said terminal for coaxial cable comprises:

a center conductor connecting portion arranged coaxially with respect to said coaxial cable to be connected to said center conductor;

an outer conductor connecting portion arranged coaxially with respect to said coaxial cable to be connected to said outer conductor; and a joint portion for detachably connecting said center conductor connecting portion and said outer conductor connecting portion, wherein said center conductor connecting portion comprises:

a center conductor press-joining portion for press-joining said center conductor;

a pair of center-conductor side grounding pieces which lead to said center conductor press-joining portion and which are arranged symmetrically with the axis of said coaxial cable between them and in contact with the surface of said mounted object; and a center-conductor side bent portion in which an outer end of said center-conductor side grounding piece is bent perpendicularly with respect to a surface portion of said center-conductor side grounding piece, wherein said outer conductor connecting portion comprises:

an outer-conductor press-joining portion for press-joining said outer conductor;

a pair of outer-conductor side grounding pieces which lead to said outer conductor press-joining portion and which are arranged symmetrically with the axis of said coaxial cable between them and in contact with the surface of said mounted object; and an outer-conductor side bent portion in which an outer end of said outer-conductor side grounding piece is bent perpendicularly with respect to a surface portion of said outer-conductor side grounding piece, and wherein said joint portion comprises:

a first joint piece for connecting one center-conductor side bent portion of said pair of center-conductor side bent portions and one outer-conductor side bent portion of said pair of outer-conductor side bent portions to each other in the axial direction of said coaxial cable, and a second joint piece for connecting the other center-conductor side bent portion of said pair of center-conductor side bent portions and the other outer-conductor side bent portion of said pair of outer-conductor side bent portions to each other in the axial direction of said coaxial cable, and wherein said method comprises:

attaching said coaxial cable to said terminal for coaxial cable by press-joining the center conductor of said coaxial cable with said center conductor press-joining portion of said center conductor connecting portion and by press-joining the outer conductor of said coaxial cable with said outer conductor press-joining portion of said outer conductor connecting portion;

mounting said center-conductor side grounding piece of said center conductor connecting portion and said outer-conductor side grounding piece of said outer conductor connecting portion on the surface of said mounted object; and removing said joint piece connecting said center-conductor side bent portion and said outer-conductor side bent portion to each other after the process of mounting said center-conductor side grounding piece and said outer-conductor side grounding piece on the surface of said mounted object.

* * * * *